United States Patent [19]

Edwards

[11] Patent Number: 4,705,249

[45] Date of Patent: Nov. 10, 1987

[54] TRASH BAG HOLDING DEVICE

[76] Inventor: Preston Edwards, 11202 Valley Heights Cir., Boise, Id. 83709

[21] Appl. No.: 912,405

[22] Filed: Sep. 29, 1986

Related U.S. Application Data

[63] Continuation-in-part of Ser. No. 728,228, Apr. 29, 1985, abandoned.

[51] Int. Cl.[4] ..... B65B 67/04

[52] U.S. Cl. ..... 248/101; 24/575

[58] Field of Search ..... 248/101, 95, 99, 316.6; 211/45, 89, 126, 8; 24/575, 576, 579

[56] References Cited

U.S. PATENT DOCUMENTS

| | | | |
|---|---|---|---|
| 632,159 | 8/1899 | Steward | 211/45 X |
| 1,851,733 | 3/1932 | Shapiro | 24/575 |
| 2,315,414 | 3/1943 | Germany | 24/575 X |
| 2,447,422 | 8/1948 | Nelson | 24/575 |
| 3,091,422 | 5/1963 | Hobbs | 248/101 |
| 3,118,542 | 1/1964 | Lewis | 211/89 |
| 3,412,965 | 11/1968 | Alexander | 248/101 |
| 4,224,974 | 9/1980 | Anderson et al. | 248/221.4 |

*Primary Examiner*—Ramon S. Britts
*Assistant Examiner*—Sarah A. Lechok Eley
*Attorney, Agent, or Firm*—O'Neil and Bean

[57] ABSTRACT

An improved bag holding device for holding and spreading the open end of a thin walled plastic trash bag includes a pair of cooperating elongated spreader bar members one of which is adapted to be mounted on a supporting wall in outwardly spaced parallel relation to the wall and the other of which is adapted to be releasably mounted on the first. The two spreader bar members have opposing clamping surfaces adapted to cooperate and clamp a portion of the bag wall adjacent the open mouth to support the bag and hold the mouth open for receiving refuse.

4 Claims, 5 Drawing Figures

FIG. 1
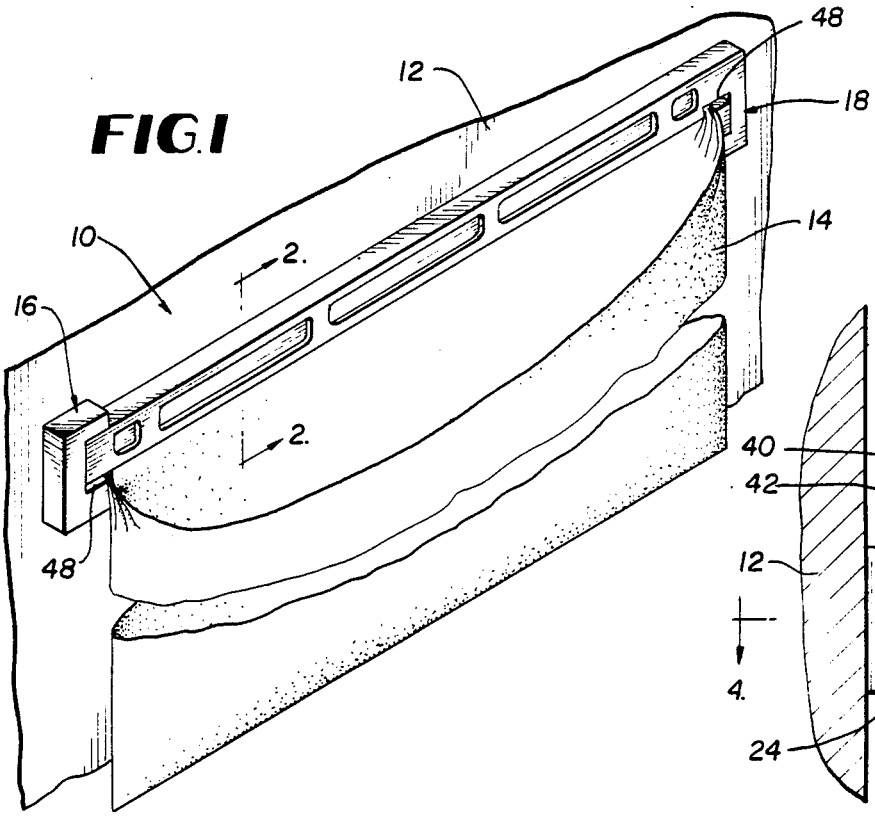
FIG. 2
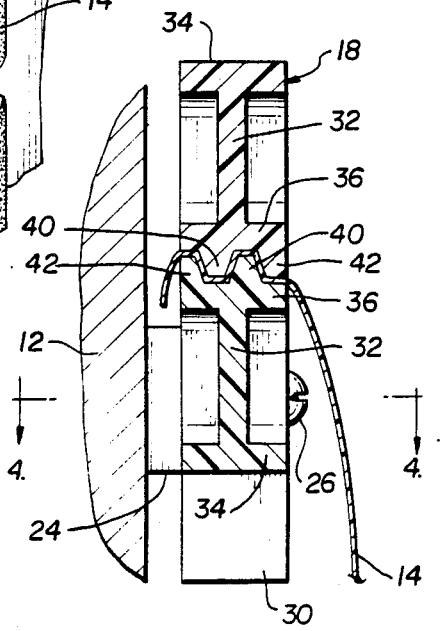
FIG. 3
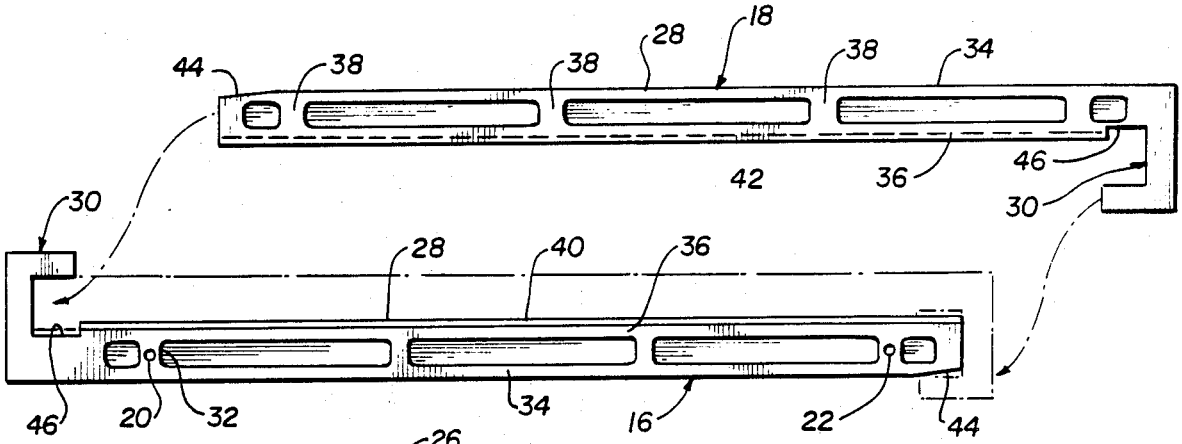
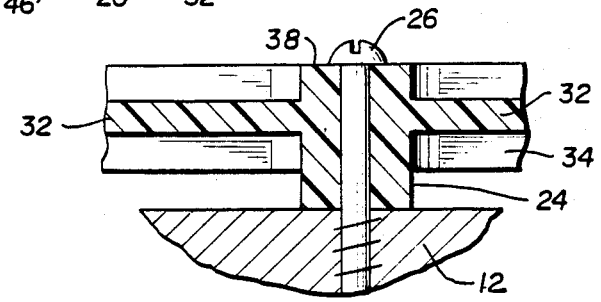
FIG. 4
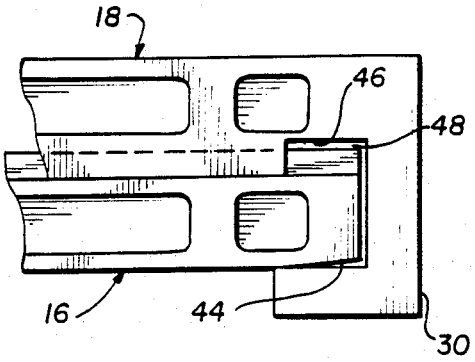
FIG. 5

TRASH BAG HOLDING DEVICE

CROSS REFERENCE TO RELATED APPLICATION

This is a continuation-in-part of my copending application Ser. No. 728,228, filed Apr. 29, 1985 now abandoned.

BACKGROUND OF THE INVENTION

1. Field of the Invention

This invention relates generally to trash bag holding devices and more particularly to an improved device for supporting and spreading or holding open the mouth portion of thin walled bags such as plastic bags of the type widely used both in the home and in business establishments for bagging refuse.

2. Description of the Prior Art

Most household and business refuse is now collected in disposable plastic bags. Such bags are normally employed as a liner for large rigid covered receptacles, or trash cans which are emptied simply by lifting the disposable bag from the can. It is frequently desirable, however, to provide such a plastic bag for collecting trash in areas where, for various reasons, it may be undesirable to employ the rigid trash can. However, the thin, slippery flexible walls of the plastic trash bags make them difficult to fill since they are incapable of supporting themselves even temporarily. Accordingly, numerous devices have been developed for supporting the open top of a plastic trash bag to facilitate filling the bag and to prevent spilling the trash during storage.

One prior art trash bag holding device is disclosed in U.S. Pat. No. 4,339,099. According to this known device, a portion of the plastic bag adjacent the open top is draped over a supporting object such as a door knob, and a resilient spring loop is then placed around the knob to retain the top of the bag above the floor. An elongated spreader bar attached to the spring extends outwardly in each direction so that the bag top may be draped or hooked over its ends to spread open the bag top. This prior art device is not entirely satisfactory, however, in that an existing supporting structure such as a door knob is not always available where it is desired to support a trash bag for receiving refuse. Further, the open top of the bag could easily be dislodged from the end portions of the spreader bar, making it more difficult to open the bag top for receipt of trash. In addition, as the bag of this prior art device is filled, weight of the trash can cause rupturing of the bag in the area supported on the door knob and may result in spilling of the contents.

U.S. Pat. No. 3,921,208 also discloses a bag holding and closing apparatus intended for supporting a flexible bag such as a conventional plastic trash bag. This device employs a pair of elongated resilient plate members joined at their end portions and adapted to have their central portions sprung apart to enable the open mouth of a trash bag to be inserted therebetween. The end of the bag is then everted back over itself and over the resilient members. To place trash in a bag held by this device, it is necessary to grasp a handle and exert sufficient force to spread and hold the plate members apart. Again, such a device is not entirely satisfactory in that it is not convenient to use, and installing an empty trash bag in the device can present substantial difficulty.

Numerous other bag holding devices are known in the art but are not entirely satisfactory for supporting the thin walled, slippery plastic trash bags now commonly used. Accordingly, it is a primary object of the present invention to provide an improved trash bag holding and spreading device.

Another object is to provide an improved trash bag holding device particularly suitable for use in supporting and holding open the mouth portion of a thin walled bag such as a plastic trash bag.

Another object is to provide such a trash bag holder which will releasably but firmly grip the wall of a trash bag along a substantial distance adjacent the open mouth while leaving the remainder of the bag mouth hanging free in position to receive trash deposited therein.

Another object is to provide such a trash bag holding device including a first member adapted to be mounted on and in outwardly spaced relation to a supporting wall in position to have the open mouth of a bag draped thereover, and a second clamping member adapted to be releasably secured to the first member to releasably but firmly clamp the bag to simultaneously hold and spread the mouth of the bag.

Another object is to provide such a trash bag holding device including a pair of elongated clamping members adapted to be releasably assembled together with elongated opposing complementary grooved clamping surfaces adapted to cooperate in the assembled relation to clamp a portion of the wall of a trash bag along a substantial distance adjacent the open mouth and providing through openings in the assembly at each end of the clamping area to permit excess bag material to pass between the clamping members in an unclamped condition.

BRIEF DESCRIPTION OF THE DRAWINGS

Other features and advantages of the present invention will be apparent from the detailed description contained hereinbelow, taken in conjunction with the drawing in which:

FIG. 1 is an isometric view of the trash bag holder according to the present invention mounted on a wall and supporting a trash bag in position to receive refuse deposited therein;

FIG. 2 is an enlarged sectional view taken along line 2—2 of FIG. 1;

FIG. 3 is an exploded elevation view showing the apparatus of FIG. 1 and illustrating the manner of assembling the device to releasably clamp a bag;

FIG. 4 is a sectional view taken along line 4—4 of FIG. 2; and

FIG. 5 is an enlarged fragmentary elevational view of a portion of the assembly shown in FIG. 1 but without a trash bag supported therein.

DESCRIPTION OF THE PREFERRED EMBODIMENT

Referring now to the drawings in detail, a trash bag holder according to the present invention is designated generally by the reference numeral 10 and illustrated in FIG. 1 as being mounted on a supporting wall 12 with a trash bag 14 having its open mouth supported and held open by the holding device. Bag holder 10 is made up of two similar cooperating spreader bar members including a lower spreader bar 16 adapted to be mounted on a supporting wall 12 and an upper spreader bar 18. Spreader bar 16 includes mounting means for supporting the assembly on and in outwardly spaced relation to wall 12, which mounting means comprises a pair of spaced openings 20, 22 (see FIG. 3) and a pair of spacer blocks 24 integrally formed on the body of spreader bar 16 with the mounting openings 20, 22 extending one through each of the spacer blocks 24. As shown in FIG. 2, suitable fastener means such as screws or nails passed through openings 20, 22 are used to mount bar 16 on wall 12. Alternatively, adhesive may be applied between the spacer blocks 24 and the wall to rigidly mount the assembly and, of course, separately formed spacers may be employed. Preferably, openings 20, 22 are on 16" centers to correspond with standard spacing of framing members for internal wall systems, enabling the device to be securely mounted on a wall by use of conventional screw fasteners 26.

The lower spreader bar 16 is made up of an elongated body or beam portion 28 having a substantially C-shaped locking joint 30 on one end. Preferably, beam 28 and the locking joint 30 are integrally formed, as by molding, from a suitable, dimensionally stable synthetic resin material such as polyethylene.

The beam portion 28 of spreader bar 16 may be of any desired cross sectional configuration to provide the necessary dimensional stability and strength, with the illustrated generally I-beam or H-beam configuration throughout a major portion of the length being preferred in order to reduce weight and conserve material in the molding operation. Thus, the beam 28 may consist of a central vertical web portion 32, a lower flange 34 and an upper flange 36, with the flanges 34, 36 being reinforced at the end portions and at spaced intervals along the length of the beam by web sections 38 having a thickness substantially equal to the width dimension of the flanges 34, 36. Described differently, beam portion 28 may be considered to be substantially rectangular in cross section with relief portions removed from each side face to form the web 32.

The upwardly directed surface of the top flange 36 has a pair of laterally spaced ridges 40, 42 extending along substantially its full length to produce a corrugated upper surface. As seen in FIG. 2, ridge 42 extends along one side edge of flange 36 whereas ridge 40 is spaced inwardly from the opposite side edge of flange 36 for reasons to be pointed out more fully hereinbelow. These ridges extend from the free end of beam 28, but terminate at the other end at a position spaced form the C-shaped locking joint 30 as more fully described hereinbelow.

The locking joint 30 includes an integrally formed, substantially L-shaped extension projecting laterally from the end portion of flange 36 to provide an undercut or recess adapted to receive the opposite or free end portion of the upper spreader bar 18.

Upper spreader 18 may be a mirror image of lower spreader bar 16 although the mounting screw holes 22 and spacer blocks 24 preferably are not provided on the upper spreader bar 18. Accordingly, a detailed description of spreader bar 18 will not be given, and like reference numerals are applied in the drawings to the corresponding portions of spreader bars 16 and 18. When upper spreader bar 18 is turned, relative to spreader bar 16, to the position shown in FIG. 3, the mirror image configuration results in the pair of longitudinally extending ridges 40, 42 of the upper spreader bar 18 being offset in the opposite direction to those of spreader bar 16 whereby the corrugated or tongue-and-groove configuration of the two will be substantially complementary and interfitting as shown in FIG. 2.

As best seen in FIG. 3, the end portion of flanges 34, adjacent the end of the beams 28 opposite the C-shaped locking joints 30, may be bevelled slightly as shown at 44 to facilitate inserting the free ends of the respective spreader bars into the C-shaped locking joints, with the inclined surfaces 44 acting to cam the corrugated surfaces of the respective beam portions toward one another as the two spreader bars are moved into assembled relation as illustrated in FIG. 2. Also, if desired, the beam portion of one or both of the spreader bars may be curved very slightly whereby the corrugated surface of the associated flange 36 is slightly convex along its length. Such slight curvature will produce a more positive gripping force between the two surfaces to firmly clamp a thin plastic sheet such as the open mouth portion of a trash bag therebetween as shown in FIG. 2. Such curvature will normally not be required, however, where the beam portions are of sufficient size to resist deflection and warping during use.

As most clearly seen in FIGS. 3 and 5, a recess 46 is formed in the body portion 28 between the end of ridges 40, 42 and locking joint 30 of spreader bars 16 and 18. These recesses 46 provide through openings 48 adjacent each end of the trash bag holder assembly for permitting the sheet material of the trash bag to pass therebetween at the ends of the clamping surface whereby wrinkles in this area will not interfere with the clamping action of the clamping surfaces.

To use the trash bag holding device just described, spreader bar 16 is mounted on a wall surface at the desired height such that a trash bag having its open mouth supported by the device will have its bottom end resting on the floor. The open mouth of the trash bag is then draped over beam portion 28, taking care to extend the plastic sheet of the bag at the mouth completely over the ridges 40, 42 along their full length so that the empty bag will be temporarily retained. In this position, the open end of the bag will drape freely over the ridges 40, 42, passing through the recess 46 at the end of bar 16 adjacent lock joint 30 and around the end portion of the bar at its free end. The second spreader bar is then grasped in the hands and moved into position as illustrated in FIG. 3 to firmly clamp the bag between the corrugated, or complementary tongue-and-grooved surfaces of opposed flanges 36. If the tapered end portions 44 are employed, moving the two spreader bars together as shown in FIG. 3 will result in a camming action between the C-shaped locking joints and the adjacent surface 44 to firmly clamp the bag. The through opening 48 will provide free open space to accommodate any bunched or wrinkled material at the ends of the clamping surfaces, thereby enabling the opposed corrugated clamping surfaces to clamp the smooth flat bag material along their full length. Preferably, however, the beams 28 are capable of limited deflection to hold bags having different wall thicknesses or to accommodate limited inadvertent wrinkles in the plastic material being clamped.

Since the length of the ridges 40, 42 are less than one-half the peripheral dimension of the bag, the excess material will result in the open end of the bag passing through openings 48 and hanging loose as shown in FIG. 1 whereby trash can easily be deposited in the bag. When the bag is filled, top spreader bar 18 is merely slid longitudinally to release the locking joints.

As shown in FIG. 2, it is important that the bag holding assembly be spaced from the supporting wall a slight distance to facilitate tucking the top end of the open bag around the clamping surface of the bottom spreader bar. Only a slight distance, for example, approximately 3/16" space between the spreader bar and the wall is required for this purpose, however, so that the entire assembly requires little space. Thus, when not in use to hold a trash bag, the entire assembly does not obstruct normal use of the space adjacent the wall 12.

While a preferred embodiment of the invention has been disclosed and described, it should be apparent that various modifications could readily be made without departing from the spirit and scope of the invention. For example, a single groove could be formed in the flange 36 of one spreader bar with a cooperating tongue formed on the flange 36 of the other spreader bar, and other surface configurations may be employed or a high friction material may be attached as by bonding to one or both clamping surfaces to assure firm clamping of the thin plastic sheet material of a conventional trash bag. Similarly, various means for holding the two spreader bars in assembled relation might be pivotally supported on an axial extension of the lower spreader bar, with a single resilient latching means employed on the opposite end of one spreader bar. Accordingly, it should be understood that the invention is not limited to the disclosed embodiments but rather it is intended to include all embodiments which would be apparent to one skilled in the art and which come within the spirit and scope of the invention.

What is claimed is:

1. A bag holding device adapted to be mounted on a supporting wall to hold and spread the open end of a thin walled flexible refuse bag, comprising a first spreader bar member, said first spreader bar member including an elongated body having an upwardly directed clamping surface extending along its length, mounting means for rigidly mounting said first spreader bar member on a supporting wall, a second spreader bar member, said second spreader bar member including a second elongated body having a downwardly directed bag clamping surface extending along its length, said clamping surfaces being adapted to clamp a portion of the wall of a bag adjacent the open mouth of the bag when the open mouth is draped over and covers the clamping surface of the first spreader bar member, means on said clamping surfaces for providing a high friction contact with the thin wall of a trash bag held in the device, said means providing high friction contact including tongue and groove means including at least one groove formed in and extending the full length of the clamping surface on one said spreader bar member and at least one complementary tongue formed on and extending the full length of the clamping surface of the other spreader bar member, locking means for releasably retaining said second spreader bar member on said first spreader bar member to firmly but releasably clamp and hold the bag whereby the remaining portion of the open bag top may be easily grasped and pulled open for receiving refuse, said locking means including a pair of generally C-shaped locking joints formed one on one end of the elongated body of each said spreader bar member and extending outwardly from the clamping surface thereon, to define an axial extension on each said body member, each said locking joint defining a longitudinally extending recess for telescopingly receiving the other end of the other elongated body to releasably retain said second spreader bar member on said first spreader bar member, said C-shaped locking joints on said spreader bar member providing a through opening at each end of the bag holding device when said first and second spreader bar members are assembled to enable excess bag material at each extremity of the clamped portion of the bag to pass between the spreader bar members without being clamped whereby a single layer only of a bag can be clamped between opposed clamping surfaces of said spreader bar members.

2. The bag holding device defined in claim 1 wherein said mounting means comprises spacing means on said first spreader bar member for engaging a support wall to retain said first spreader bar in outward relation to the supporting wall.

3. The bag holding device defined in claim 1 wherein said tongue and groove means comprises a pair of laterally spaced parallel tongues formed on each said clamping surface, each said pair of laterally spaced tongues cooperating to define a groove therebetween in position for receiving one of the tongues of the other pair of tongues.

4. The bag holding device defined in claim 3 wherein said locking means comprises means for urging said clamping surfaces toward one another when said second spreader bar member is mounted on said first spreader bar member.

* * * * *